United States Patent [19]

Isoda et al.

[11] Patent Number: 4,927,728

[45] Date of Patent: May 22, 1990

[54] CARRIER PARTICLES FOR USE IN A TWO-COMPONENT DRY-TYPE DEVELOPER

[75] Inventors: Tetsuo Isoda; Yoichiro Watanabe; Nobuhiro Nakayama; Mitsuo Aoki, all of Shizuoka, Japan

[73] Assignee: Ricoh Company, Ltd., Tokyo, Japan

[21] Appl. No.: 276,279

[22] Filed: Nov. 23, 1988

Related U.S. Application Data

[63] Continuation-in-part of Ser. No. 656,115, Sep. 28, 1984, abandoned.

[30] Foreign Application Priority Data

Oct. 4, 1983 [JP] Japan ..... 58-185517

[51] Int. Cl.[5] ..... G03G 9/10

[52] U.S. Cl. ..... 430/108; 428/405; 524/908; 525/934

[58] Field of Search ..... 430/108; 428/405; 524/908; 525/934

[56] References Cited

FOREIGN PATENT DOCUMENTS

| | | |
|---|---|---|
| 3436410 | 4/1985 | Fed. Rep. of Germany . |
| 116349 | 7/1982 | Japan . |
| 60-76754 | 5/1985 | Japan . |
| 2147714 | 5/1985 | United Kingdom . |

*Primary Examiner*—J. David Welsh

*Attorney, Agent, or Firm*—Flynn, Thiel, Boutell & Tanis

[57] ABSTRACT

The disclosure describes carrier particles for use in a two-component dry-type developer, consisting of core particles which are coated with a silicone resin hardened by an organic tin catalyst.

6 Claims, 7 Drawing Sheets

CARRIER PARTICLES FOR USE IN A TWO-COMPONENT DRY-TYPE DEVELOPER

The present application is a continuation-in-part, application Ser. No. 06/656,115, filed Sept. 28, 1984 now abandoned.

BACKGROUND OF THE INVENTION

The present invention relates to carrier particles for use in a two-component dry-type developer for developing latent electrostatic images to visible images, for use in electrophotography, electrostatic recording and electrostatic printing, and more particularly to carrier particles coated with a silicone resin which is hardened by an organic tin catalyst.

Conventionally, as a developer for use in these fields, the so-called two-component dry-type developer is known, which comprises (i) carrier particles made of, for example, iron particles or glass beads, and (ii) toner particles made of, for example, resins and coloring agents. In the two-component dry-type developer, the particle size of the toner particles is very much smaller than the particle size of the carrier particles, and the toner particles are triboelectrically attracted to the carrier particles and are held on the surface of the carrier particles. The electric attraction between the toner particles and the carrier particles is generated by the friction between the toner particles and the carrier particles. When the toner particles held on the carrier particles are brought near or into contact with a latent electrostatic image, the electric field of the latent electrostatic image works on the toner particles so as to separate the toner particles from the carrier particles, overcoming the bonding between the toner particles and the carrier particles, with the result that the toner particles are attracted toward the latent electrostatic image,so that the latent electrostatic image is developed to a visible image. In the case of the two-component dry-type developer, since only the toner particles are consumed in the course of development, it is necessary to replenish the toner particles from time to time during the development of latent electrostatic images.

Further, it is necessary to triboelectrically charge the toner particles to the desired polarity and with a sufficient amount of charge, and to maintain the amount of the electric charge and polarity thereof for a sufficiently long period of time for use. In the case of a conventional two-component type developer, it is apt to occur that the surface of the carrier particles is eventually covered with the resin contained in and released from the toner particles in the course of the mechanical mixing of the toner particles and the carrier particles in a development apparatus. Once the surface of the carrier particles is covered with the resin, which is generally referred to as the "spent phenomenon", such carrier particles no longer function as active carrier particles capable of substantially charging toner particles for development. As a result, the charging characteristics of the carrier particles deteriorate with time while in use. In the end, it becomes necessary to replace the entire developer by a new developer in the case of a conventional two-component dry-type developer.

In order to prevent such spent phenomenon, a method of coating the surface of carrier particles with a variety of resins has been proposed. For instance, carrier particles coated with a styrene-methacrylate copolymer, polystyrene or a silicone resin are known.

Resins which can prevent the spent phenomenon, however, have not been discovered. At one extreme, for instance, carrier particles coated with a styrene methacrylate copolymer are excellent in the triboelectric charging properties. However, since the surface energy of the carrier particles is comparatively high, the carrier particles are easily covered with the resin contained in the toner particles while in use. As a result, the spent phenomenon occurs easily. Accordingly, the life of such developer is not long enough for practical use. Since carrier particles coated with a silicone resin have a small surface energy, the spent phenomenon hardly takes place. However, since the silicone resin itself has a small charging capability of electrically charging toner particles, it cannot be practically used without any modification to the resin. Therefore, when silicone-resin-coated carriers are employed, a polarity control agent capable of charging toner particles with an appropriate quantity of electric charges has to be added to the developer. As such polarity control agent, for instance, metal-complex-containing type monoazo dyes, metal-complex-containing type diazo dyes, and di- or triphenylmethane dyes are known. These dye polarity control agents, however, are expensive and a large amount of the agents is necessary when used in practice. When they are added to the toner and are mixed with the toner for a long period of time, the development performance of the developer gradually deteriorates. Eventually, high image quality cannot be obtained in a stable manner.

SUMMARY OF THE INVENTION

It is therefore an object of the present invention to provide carrier particles for use in a two-component dry-type developer, which carrier particles are coated with a silicone resin having a high capability for charging the toner particles and a small surface energy, so that the toner particles are free from the spent phenomenon, and addition of a polarity control agent to the toner is substantially unnecessary.

Another object of the present invention is to provide inexpensive and high quality carrier particles of the above-mentioned type for use in a two-component dry-type developer capable of yielding high quality images in a stable manner, for which, if a polarity control agent is added thereto, only a small amount of a dye polarity control agent is significantly effective for appropriately increasing the charge quantity of the toner and, therefore, the development performance of the developer is not degraded for a prolonged period of time.

According to the present invention, the above objects are attained by carrier particles coated with a silicone resin which is hardened by use of an organic tin compound as a catalyst for the hardening.

μC/g prepared in Example 1 and the number of copies made continuously by use of a comparative developer containing the toner having the same quantity of electric charge prepared in Comparative Example 1.

Figure 3:
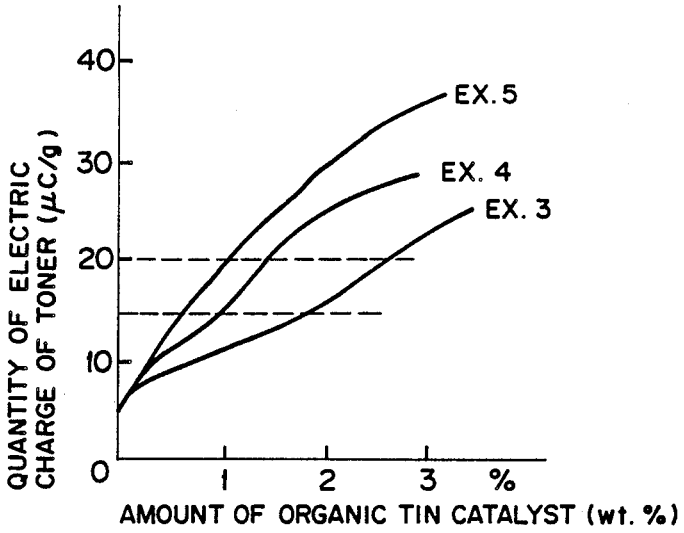

FIG. 3 is a graph showing the relationship between the quantity of electric charge of a toner and the amount of an organic catalyst contained in the silicone resin coated layers of the carrier particles in two-component dry-type developers containing the toner prepared in Examples 3, 4, and 5.

Figure 4:
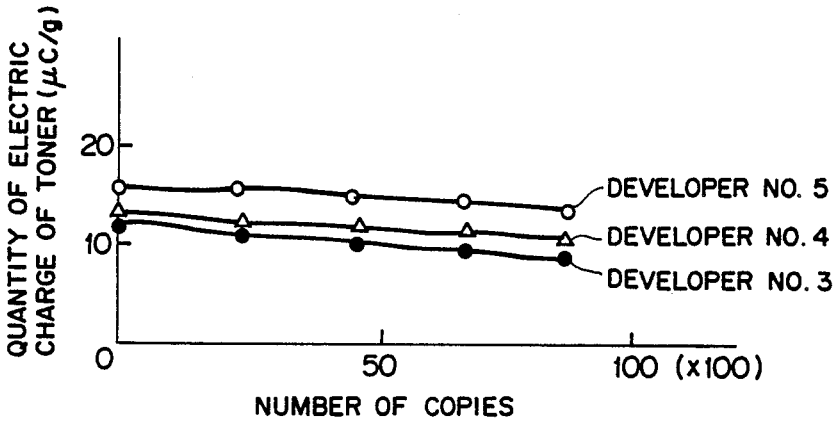

FIG. 4 is a graph showing the relationship between the quantity of electric charge of the toner and the number of copies made continuously by use of two-component dry-type developers No. 3, No. 4 and No. 5 containing the toner having a quantity of electric charge thereof 15 μC/g prepared in Examples 3, 4 and 5.

Figure 5:
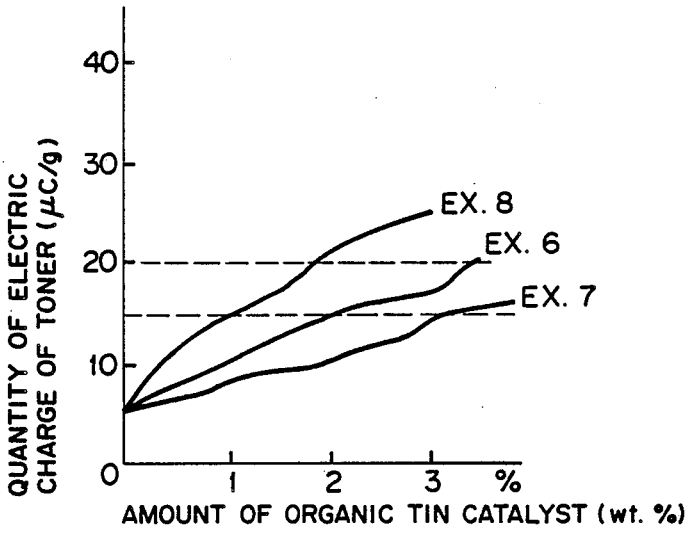

FIG. 5 is a graph showing the relationship between the quantity of electric charge of a toner and the amount of an organic catalyst contained in the silicone resin coated layers of the carrier particles in two-component dry-type developers containing the toner prepared in Examples 6, 7, and 8.

Figure 6:
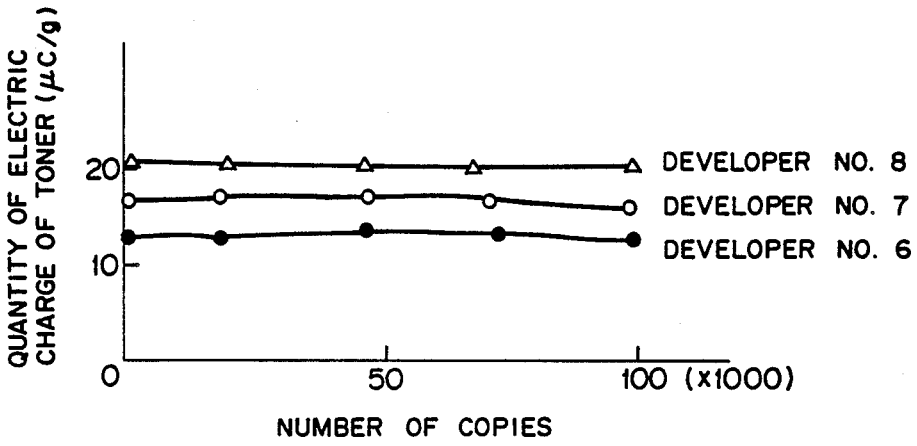

FIG. 6 is a graph showing the relationship between the quantity of electric charge of the toner and the number of copies made continuously by use of the two-component dry-type developers No. 6, No. 7 and No. 8 containing the toner having a quantity of electric charge thereof 15 μC/g prepared in Examples 6, 7 and 8.

Figure 7:
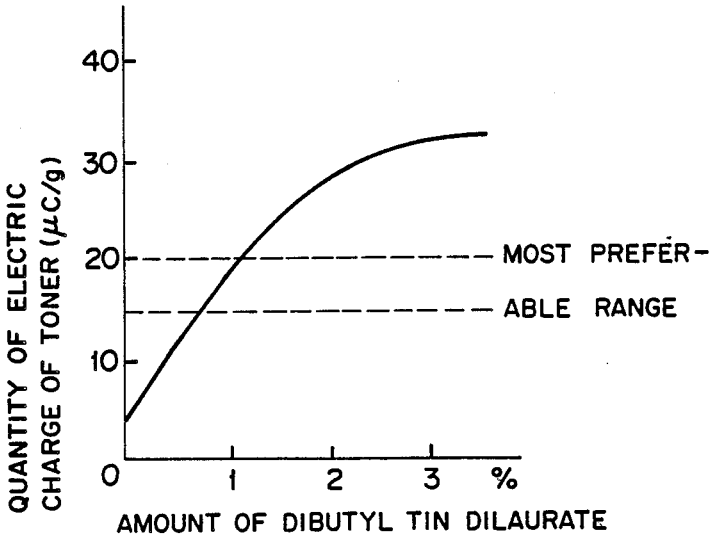

FIG. 7 is a graph showing the relationship between the quantity of electric charge of a toner and the amount of an organic catalyst contained in the silicone resin coated layers of the carrier particles in two-component dry-type developers containing the toner prepared in Example 9.

Figure 8:
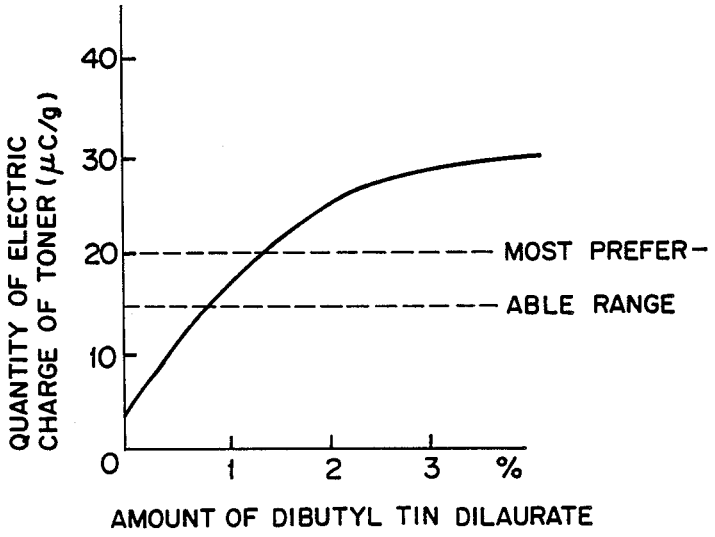

FIG. 8 is a graph showing the relationship between the quantity of electric charge of a toner and the amount of an organic catalyst contained in the silicone resin coated layers of the carrier particles in two-component dry-type developers containing the toner prepared in Example 10.

Figure 9:
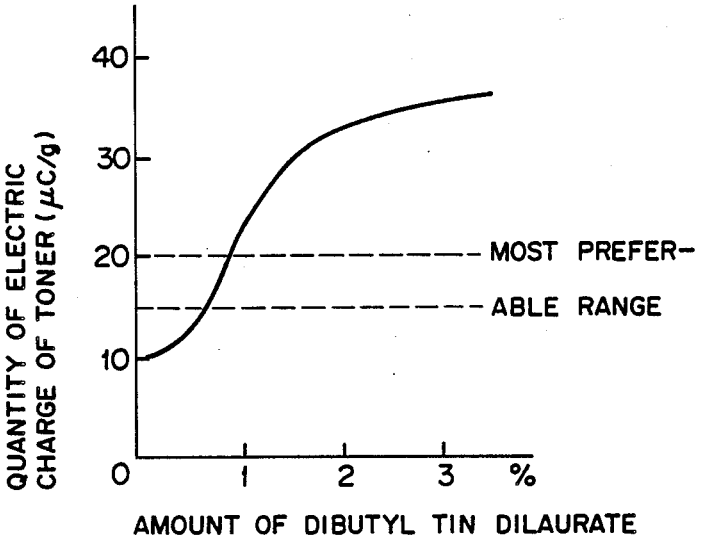

FIG. 9 is a graph showing the relationship between the quantity of electric charge of a toner and the amount of an organic catalyst contained in the silicone resin coated layers of the carrier particles in two-component dry-type developers containing the toner prepared in Example 11.

Figure 10:
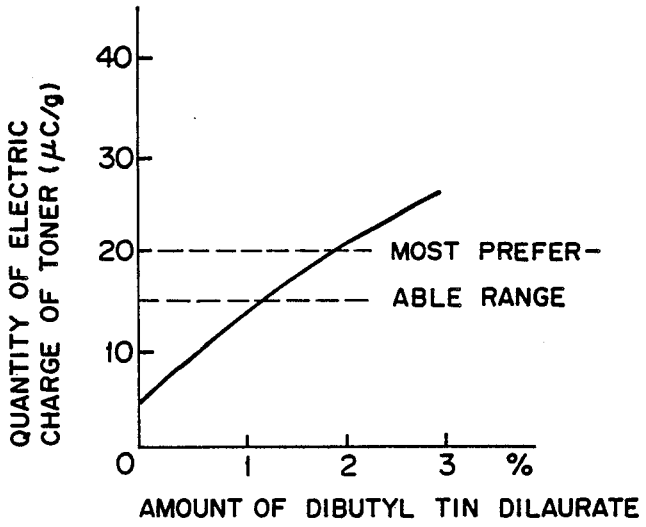

FIG. 10 is a graph showing the relationship between the quantity of electric charge of a toner and the amount of an organic catalyst contained in the silicone resin coated layers of the carrier particles in two-component dry-type developers containing the toner prepared in Example 13.

Figure 11:
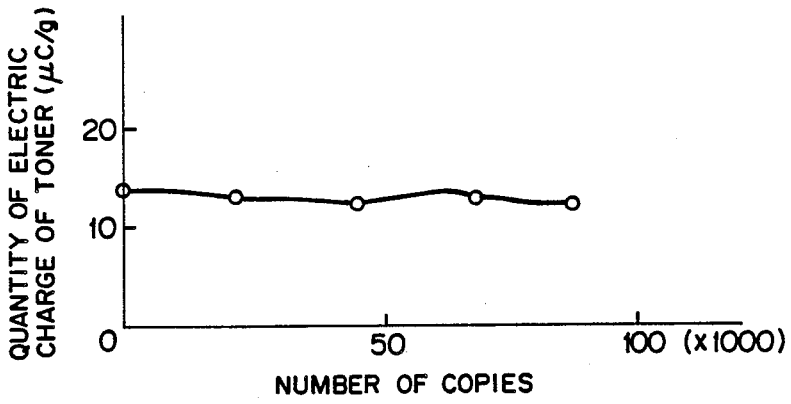

FIG. 11 is a graph showing the relationship between the quantity of electric charge of the toner and the number of copies made continuously by use of a two-component dry-type developer No. 9 containing the toner having a quantity of electric charge thereof 15 μC/g prepared in Example 13.

Figure 12:
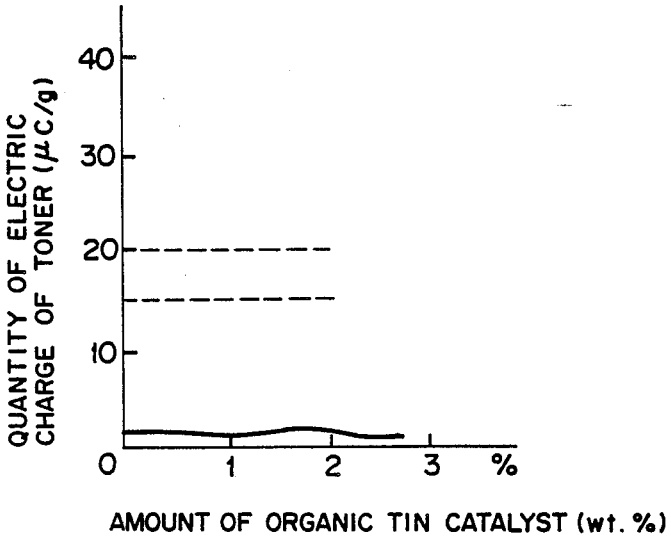

FIG. 12 is a graph showing the relationship between the quantity of electric charge of a toner and the amount of an organic catalyst contained in the silicone resin coated layers of the carrier particles in two-component dry-type developers containing the toner prepared in Comparative Example 2.

Figure 13:
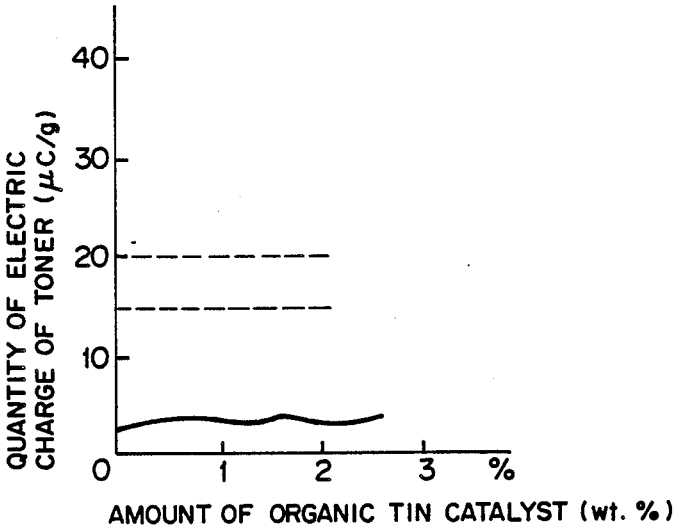

FIG. 13 is a graph showing the relationship between the quantity of electric charge of a toner and the amount of an organic catalyst contained in the silicone resin coated layers of the carrier particles in two-component dry-type developers containing the toner prepared in Comparative Example 3.

Figure 14:
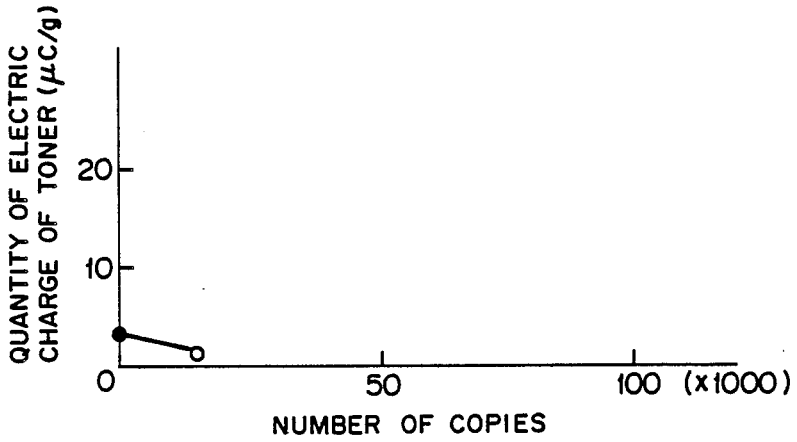

FIG. 14 is a graph showing the relationship between the quantity of electric charge of the toner and the number of copies made continuously by use of a comparative two-component dry-type developer No. 2 containing the toner prepared in Example 13.

DETAILED DESCRIPTION OF THE PREFERRED EMBODIMENTS

Generally a hardened silicone resin is prepared by hardening a silicone varnish at room temperature or with application of heat thereto, when necessary, in the presence of a hardening catalyst. The silicone varnish can be classified into two-types, that is, a one-liquid type for which no hardening catalyst is necessary, and a two-liquid type for which a hardening catalyst is necessary. When a two-liquid type silicone varnish is employed, the silicone resin can be obtained by heating the two-liquid type silicone varnish, for instance, at temperatures ranging from about 100° C. to about 250° C. in the presence of a hardening agent.

In the case where as the raw material of the silicone resin, a solvent type varnish is employed, which is a silanol obtained by hydrolysis of a silane that can be hydrolyzed, such as an organochlorosilane, the above hardening reaction is caused to take place by dehydrating condensation of the terminal hydroxy groups contained in the silanol. As the hardening catalysts employed in this reaction, acids, alkalis, amines and organic acid metal salts, titanate and borate are effective. In particular, organic acid salts such as zinc, lead, cobalt, tin and iron octylates and laurates, and amines such as triethanol amine and choline hexanoate are in general use.

In the case where a solvent-free type varnish is employed, which is an oily polysiloxane having olefine groups such as vinyl group, the hardening reaction takes place due to the polymerization of the olefine groups in the polysiloxane. The hardening reaction occurs at lower temperatures in the solvent-free type varnish than in the solvent-type varnish.

The silicone resin for use in the present invention is an organopolysiloxane with a three-dimensional network structure including Si-O-Si bonds as the main chain as shown by the following formula:

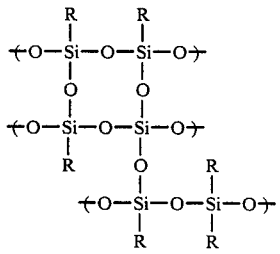

wherein R represents a lower alkyl group, a phenyl group, an alkyd-modified-, an acryl-modified-, an epoxy-modified-, an amino-modified-, a carboxy-modified-, an alcohol-modified-, a fluorine-modified-, a polyether-modified-, an urethane-modified-, a nitrile-modified- or a polyester-modified-lower alkyl group or -phenyl group, and some R represents hydrogen, a lower alkoxy group, a hydroxyl group or a vinyl group.

In other words, as the two-liquid type silicone varnish, in addition to a non-modified silicone, there can be employed an alkyd-modified-silicone, an acryl-modified-silicone, an epoxy-modified-silicone, an amino-modified-silicone, a carboxy-modified-silicone, an alcohol-modified-silicone, a fluorine-modified-silicone, a polyether-modified-silicone, an urethane-modified-silicone, a nitrile-modified-silicone and a polyester-modified-silicone.

The one-liquid type silicone varnish of a solvent-free type reacts with water present in the air at room temperature, so that it becomes hardened. In the one-liquid type silicone varnish, there are, for example, a deaceticacid type, a deoxime type, dealcohol type and deamine type.

The inventors of the present invention have discovered that, of a variety of silicone resins, silicone resins that are hardened by use of an organic tin compound as hardening catalyst have a capability of applying high electric charges to toner without addition of any polarity control agent and that the quantity of electric charge of the toner can be controlled by the amount of the organic tin compound employed. The present invention has been made from this discovery.

The raw silicone materials for the silicone resins for use in the present invention are required to be hardened by use of an organic tin compound. Therefore as the raw silicone materials, two-liquid type silicone varnishes and two-liquid type modified silicone varnishes are employed in the present invention.

Examples of such organic tin compounds are as follows:

(No. 1) $R_2Sn(OCOR')_2$ wherein R and R' each represent an alkyl group of $C_1$–$C_{12}$.

(No. 2) $[H_3C(CH_2)_3]_2Sn(OCOCH_3)-O-Sn[(CH_2)_3CH_3]_2(OCOCH_3)$ (No. 3) $\{[H_3C(CH_2)_3]_2Sn(H_3COCO)-O\}_4Si$ (No. 4) $[CH_3(CH_2)_3]_2Sn(OCH_3)_2$ (No. 5)

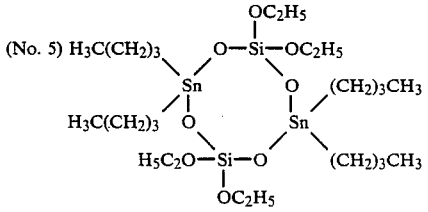

(No. 6)

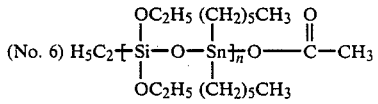

(No. 7) $[(CH_3C(=O)Sn(CH_2)_3(CH_3)_2)_2O]_2$

The amount of the organic tin compound employed varies depending upon the kind of the silicone that is used as the raw material and the charge-application capability of the silicone resin. Generally, the amount of the organic tin compound is in the range of about 0.1 wt. % to about 3 wt. % of the non-volatile components of the silicone employed as the raw material.

As the core material of the carrier particles, for example, magnetic metals such as iron, nickel, cobalt, ferrite, non-magnetic metals such as copper and bronze, and non-metallic materials such as Carborundum, glass beads and silicone dioxide can be employed.

It is preferable that the particle size of the carrier particles be in the range of from 30 μm to 1,000 μm, more preferably in the range of from 50 μm to 500 μm.

The silicone-resin-coated carrier particles according to the present invention can be prepared by dissolving the above-mentioned raw silicone material and an organic tin compound in an appropriate organic solvent to prepare a coating liquid, followed by coating the core particles of the carrier particles with the coating liquid by immersing the core particles in the coating liquid, by spraying the coating liquid on the carrier particles or by a fluidized bed process which will be explained later, and when necessary, with application of heat thereto at temperatures ranging from about 100° C. to about 250° C., thus hardening the coated silicone resin layer.

It is preferable that the thickness of the coated silicone resin layer be in the range of about 0.1 μm to about 20 μm .

As the organic solvent for dissolving the raw silicone material and the organic tin compound therein, any solvents can be employed so long as the raw silicone material and the organic tin compound can be dissolved therein. Specific examples of such solvents are alcohols such as methanol, ethanol and isopropanol, aromatic hydrocarbons such as toluene and xylene, ketones such as acetone and methyl ethyl ketone, and tetrahydrofuran and dioxane, and mixtures of the above.

To the coating liquid, there can be added metal salts of organic acids, that is, metal soaps, such as lead-, iron-, cobalt-, manganese-, zinc-octylates and -naphthenates, and amines.

Preparation of the silicone-resin coated carriers according to the present invention by the above-mentioned fluidized bed process is performed as follows:

Core particles are elevated to a balanced height by a stream of a pressure-applied gas (usually stream of pressure-applied air) which flows upwards within a fluidized bed apparatus. While the elevated core particles are suspended in the upwardly flowing air stream, the coating liquid is sprayed on the core particles of the carrier particles. The above step is repeated until the core particles are coated with a silicone resin layer with the desired thickness.

As the toner which constitutes a two-component type dry developer in combination with the above prepared carrier particles, a toner which essentially consists of a resin and a coloring agent can be employed, when necessary, with addition of a variety of polarity control agents thereto.

As the coloring agent, the following dyes, pigments and mixtures thereof can be employed: carbon black, Nigrosine dye (C.I. No. 504158), Aniline Blue (C.I. NO. 50405), Calconyl Blue (C.I. No. Azess Blue 3), Chrome Yellow (C.I. No. 14090), Ultramarine Blue (C.I. No. 77103), Methylene Blue Choride (C.I. No. 52015), Phthalocyanine Blue (C.I. No. 74160), Du Pont Oil Red (C.I. No. 26105), Quinoline Yellow (C.I. No. 47005), Malachie Green Oxalate (C.I. No. 42000), Lamp Black (C.I. No. 77266), Rose Bengale (C.I. No. 45435) and Zabon First Black (C.I. No. 12195 Solvent Dye).

Of the above dyes, Nigrosine dye is an inexpensive polarity control agent for positive polarity.

As the resin for the toner, styrene resins such as polystyrene and copolymers of styrene and other vinyl monomers are mainly employed. As the other vinyl monomers, there can be employed olefines such as ethylene, propylene and isobutylene; halogenated vinyl monomers such as vinyl chloride, vinyl bromide and vinyl fluoride; vinyl esters such as vinyl acetate; acrylic acid esters such as methyl acrylate, ethyl acrylate and phenyl acrylate; vinyl ethers such as vinyl methyl ether and vinyl ethyl ether; vinyl ketones such as vinyl methyl ketone and vinyl hexyl ketone; N-vinyl compounds such as N-vinylpyrrole and N-vinyl-pyrrolidone; acrylonitrile; methacrylonitrile; acrylamide; methacrylamide; and mixtures of the above compounds.

In addition to the above styrene resins, polyethylene, polypropylene, polyvinyl ester, rosin-modified phenolic resin, epoxy resin, acrylic resin and polyester resin can be employed as the resins for the toner.

When preparing a two-component dry-type developer by use of the carrier particles according to the present invention, it is preferable that the mixing ratio of the toner to the carrier particles be in the range of 1:20–100 in terms of weight ratio.

In the carrier particles according to the present invention, since a silicone resin having a low surface energy and a high charge application capability to toner is employed, the so-called "spent phenomenon" of the toner hardly occurs while the developer is used. Furthermore, it is substantially unnecessary to add a polarity control agent to the toner. Even if a polarity control agent is added to the toner, it is unnecessary to add such an expensive dye polarity control agent as employed in the case of conventional toner, but a small amount of an inexpensive dye will do, since the carrier particles are coated with a silicone resin having a high charge application capability as mentioned above. Therefore, the developer does yield stable images free from fogging, without deterioration even if it is used for a long period of time.

Embodiments of the present invention will now be explained by referring to the following examples, in which the term "part(s)" means part(s) by weight.

EXAMPLE 1

In a round-bottom flask with a stirrer were placed 12 parts of toluene, 14 parts of butanol, 14 parts of water and 34 parts of ice. To the resulting solution were very slowly added, with stirring, 26 parts of a silane mixture consisting of $CH_3SiCl_3$ and $(CH_3)_2SiCl_2$ with the respective molar ratio of 10:1. The mixture was stirred for 30 minutes. The resulting mixture was separated into two layers, an aqueous layer and an organic liquid layer which was referred to as the siloxane layer. The siloxane layer was separated from the aqueous layer. To this siloxane layer was added 26 parts of concentrated hydrochloric acid. Thereafter, the mixture was heated with stirring at 50° C. to 60° C., thus a condensation reaction was caused to take place. About one hour later, a hydrochloric acid layer was removed. The resulting siloxane was washed with water two times. The thus washed siloxane was dissolved in a mixed solvent consisting of toluene, butanol and ligroin, whereby a 10% silicone varnish was prepared.

To the thus prepared 10% silicone varnish was added dibutyl tin dilaurate in an amount of 0 wt. %, 0.1 wt. %, 1.0 wt. %, 2.0 wt. % and 3.0 wt. %, respectively, based on the amount of the non-volatile components contained in the 10% silicone varnish. Each of the thus prepared 5 different mixtures was diluted with toluene in an amount of 15 times in volume the volume of each mixture, whereby 5 different coating liquids were prepared.

Each of the thus prepared coating liquids was applied to spherical iron particles with an average particle size of 100 μm in an atmosphere of 90° C. in a circulation-type fluidized bed apparatus. Thus, the iron particles were coated with the silicone varnish and were then dried. Thereafter, the silicone-resin-coated iron particles were heated at 250° C. for 30 minutes for the hardening reaction of the silicone resin, whereby 5 different silicone-resin coated carriers according to the present invention were prepared.

A toner for use in combination with the above-prepared carrier particles was prepared by mixing 100 parts of a styrene-n-butyl methacrylate copolymer ("Himer SBM 73" made by Sanyo Chemical Industries, Ltd.), 1 part of Nigrosine dye ("Spirit Black SB" made by Oriental Chemical Industries, Ltd.), and 10 parts of carbon black.

3 parts of the thus prepared toner and 100 parts of each of the 5 different carrier particles were separately mixed, whereby 5 two-component dry-type developers were prepared. The quantity of electric charge of each toner in each developer was measured. The results are shown in FIG. 1.

Figure 1:
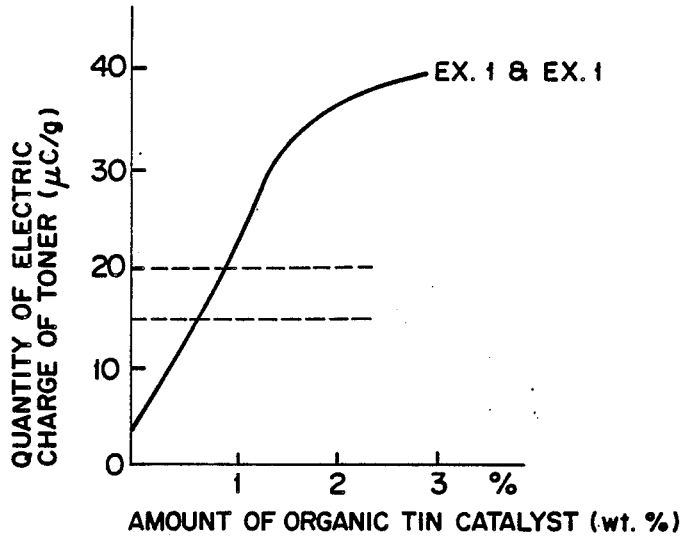
FIG. 1 is a graph showing the relationship between the quantity of electric charge of a toner and the amount of an organic tin catalyst contained in the silicone resin coated layer of the carrier particles in two-component dry-type developers containing the toner prepared in Example 1.

It is preferable that the quantity of electric charge of the toner be in the range of from 10 μC/g to 25 μC/g, and the most preferable range is from 15 μC/g to 20 μC/g as indicated by the dotted lines in FIG. 1. As can be seen from the results shown in FIG. 1, there is a distinct relationship between the quantity of electric charge of the toner and the amount of the organic tin catalyst (dibutyl tin dilaurate), which indicates that the quantity of electric charge of toner can be controlled by controlling the amount of the organic tin catalyst.

A developer No. 1 with the quantity of electric charge of the toner being 15 μC/g which was within the above-mentioned appropriate range, containing the organic tin catalyst (dibutyl tin dilaurate), was prepared in the same manner as mentioned above. By use of this developer, 100,000 copies were made by a commercially available dry-type electrophotographic copying machine. The results are shown in the graph in FIG. 2. In the graph, a curve 1 indicates the change of the quantity of electric charge of the toner in the developer No. 1 containing the carrier particles according to the present invention, and a curve 2 indicates the change of the quantity of electric charge of a toner in a comparative developer No. 1 containing comparative carrier particles which will be explained in detail later in Comparative Example 1. As can be seen from this graph, in the developer utilizing the carrier particles according to the present invention, the quantity of electric charge of the toner scarcely changes during the course of making 100,000 copies, yielding stable images free from fogging. In contrast to this, in the case of the developer containing the comparative carrier particles, the quantity of electric charge of the toner increased as the number of copies increased. The result was that the image density decreased in the course of making copies and stable images were not obtained, although fogging was not observed as will be explained in more detail.

EXAMPLE 2

Example 1 was repeated except that dibutyl tin dilaurate employed in Example 1 was replaced by dipropyl tin dilaurate, whereby 5 two-component dry-type developers were prepared and the quantity of electric charge of each toner of the developers was measured in the same manner as explained in Example 1. The results were almost the same as those shown in FIG. 1.

Figure 2:
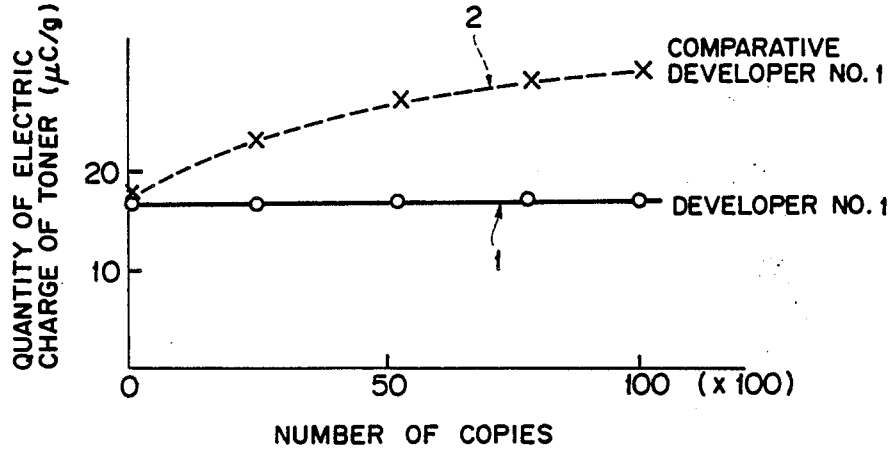
FIG. 2 is a graph showing the relationship between the quantity of electric charge of the toner and the number of copies made continuously by use of a two-component dry-type developer No. 1 containing the toner having a quantity of electric charge thereof 15

A developer No. 2 with the quantity of electric charge of the toner being 15 μC/g which was within the previously mentioned appropriate range, containing the organic tin catalyst (dipropyl tin dilaurate), was prepared in the same manner as mentioned in Example 1. By use of this developer, 100,000 copies were made by a commercially available dry-type electrophotographic copying machine. The results were almost the same as shown in FIG. 2.

EXAMPLES 3~5

Example 1 was repeated except that dibutyl tin dilaurate employed in Example 1 was replaced with the organic tin catalysts No. 2 to No. 4 as shown previously, whereby 5 two-component dry-type developers for each of the organic tin catalysts No. 2 to No. 4 were prepared and the quantity of electric charge of each toner of the developers was measured in the same manner as explained in Example 1. The results are shown in FIG. 3.

Developer No. 3, No. 4, No. 5 with the quantity of electric charge of each toner thereof being 15 μC/g which was within the previously mentioned appropriate range, containing the organic tin catalysts No. 2, No. 3 and No. 4 were prepared in the same manner as mentioned in Example 1. By use of these developers, 100,000 copies were made by a commercially available dry-type electrophotographic copying machine. The results are shown in FIG. 4.

EXAMPLES 6~8

Example 1 was repeated except that dibutyl tin dilaurate employed in Example 1 was replaced with the organic tin catalysts No. 5 to No. 7 as shown previously, whereby 5 two-component dry-type developers for each of the organic tin catalysts No. 5 to No. 7 were prepared and the quantity of electric charge of each toner of the developers was measured in the same manner as explained in Example 1. The results are shown in FIG. 5.

Developer No. 6, No. 7 and No. 8 with the quantity of electric charge of each toner thereof being 15 μC/g which was within the previously mentioned appropriate range, containing the organic tin catalysts No. 5, No. 6 and No. 7, were prepared in the same manner as mentioned in Example 1. By use of these developers, 100,000 copies were made by a commercially available dry-type electrophotographic copying machine. The results are shown in FIG. 6.

EXAMPLE 9

Example 1 was repeated except that Nigrosine dye employed in the toner in Example 1 was replaced by Methyl Violet (C.I. 42535) (made by Wako Chemical Industries, Ltd.), a triphenylmethane dye serving as a polarity control agent for positive polarity, whereby two-component dry-type developers were prepared and the quantity of electric charge of each toner of the developers was measured in the same manner as explained in Example 1. The results are shown in FIG. 7.

EXAMPLE 10

Example 1 was repeated except that Nigrosine dye employed in the toner in Example 1 was replaced by tetrabutylammonium chloride, which is a charge control agent for positive polarity, whereby two-component dry-type developers were prepared and the quantity of electric charge of each toner of the developers was measured in the same manner as explained in Example 1. The results are shown in FIG. 8.

EXAMPLE 11

Example 1 was repeated except that Nigrosine dye employed in the toner in Example 1 was replaced by Spilon Black BH (made by Hodogaya Chemical Co., Ltd.), a metal-complex-containing type diazo dye serving as a polarity control agent for negative polarity, whereby two-component dry-type developers were prepared and the quantity of electric charges of each toner of the developers was measured in the same manner as explained in Example 1. The results are shown in FIG. 9.

The fact that the quantity of electric charge in toner, either for positive toner or for negative toner, increases as the amount of the added organic tin catalysts increases cannot be explained in terms of conventional triboelectric charging series. However, what can be said about the organic tin catalysts is that the catalysts can provide the electrically neutral silicone with a particular charging capability of charging toners regardless of the polarity thereof.

COMPARATIVE EXAMPLE 1

10 g of a mixture of an alkyd-modified silicone resin and a hardening catalyst consisting of cobalt octylate, manganese naphthenate and calcium naphthenate (which mixture is commercially available under a trade mark of EI-3045 from Dow Corning Co., Ltd. and the formulation thereof is unknown to customers) was dissolved in 500 m of toluene to prepare a coating liquid.

Iron particles with an average particle size of 100 μm were coated with the above prepared coating liquid in the same manner as in Example 1, whereby comparative alkyd-modified silicone resin coated carrier particles were obtained.

100 parts by weight of the thus prepared carrier particles and 3 parts of the same toner as that prepared in Example 1 were mixed, whereby a two-component dry-type developer was prepared. The quantity of electric charge in the toner in the thus prepared developer was about 5 μC/g which was almost the same as the carrier particles prepared without employing the organic tin catalyst in Example 1 (refer to FIG. 1).

In order to obtain a toner having an appropriate quantity of electric charge of 15 μC/g, a comparative two-component dry-type developer No. 1 was prepared except that the amount of Nigrosine dye employed was increased three times in the above mentioned preparation. By use of the thus prepared developer, 100,000 copies were made by the previously mentioned copying machine. The result was that the quantity of electric charge of the toner increased as the number of copies increased and the image density decreased in the course of making copies and stable images were not obtained, although fogging was not observed.

EXAMPLE 12

10 g of mixture of an alkyd-modified silicone resin (commercially available from Dow Corning Co., Ltd.) and dibutyl tin laurate with a mixing ration of 100:0.8 in terms of parts by weight (measured only the solid components with respect to the silicone resin) dissolved in 500 m of toluene to prepare a coating liquid.

Iron particles with an average particle size of 100 μm were coated with the above prepared coating liquid in the same manner as in Example 1, whereby alkyd-modified silicone resin coated carrier particles according to the present invention were obtained.

100 parts by weight of the thus prepared carrier particles and 3 parts of the same toner as that prepared in Example 1 were mixed, whereby a two-component dry-type developer as prepared.

By use of this developer, 100,000 copies were made as in Example 1. The results were as good and in Example 1.

EXAMPLE 13

Example 1 was repeated except that dibutyl tin dilaurate employed in Example 1 was replaced by dibutyl tin dioctoate ($(C_4H_9)_2Sn(OCOC_7H_{15})_2$), whereby 5 two-component dry-type developers were prepared and the quantity of electric charge of each toner of the developers was measured in the same manner as explained in Example 1. The results are shown in FIG. 10.

A developer No. 9 width the quantity of electric charge of the toner being 15 μC/g which was within the previously mentioned appropriate range, containing the organic tin catalyst (dibutyl tin dioctoate), was prepared in the same manner as mentioned in Example 1. By use of this developer, 100,000 copies were made by a commercially available dry-type electrophotographic copying machine. The results are shown in FIG. 11.

COMPARATIVE EXAMPLE 2

Example 1 was repeated except that dibutyl tin dilaurate employed in Example 1 was replaced by zinc dioctoate ($Zn(OCOC_7H_{15})_2$), whereby 5 two-component dry-type developers were prepared and the quantity of electric charge of each toner of the developers was measured in the same manner as explained in Example 1. The results are shown in FIG. 12, which indicate that the charging level of the toners was too low to be used in practice in electrophotographic development.

COMPARATIVE EXAMPLE 3

Example 1 was repeated except that dibutyl tin dilaurate employed in Example 1 was replaced by tin dioctoate ($Sn(OCOC_7H_{15})_2$), whereby 5 two-component dry-type developers were prepared and the quantity of electric charge of each toner of the developers was measured in the same manner as explained in Example 1. The results are shown in FIG. 13, which indicate that the charging level of the toners was too low to be used in practice in electrophotographic development.

A comparative developer No. 2 with the quantity of electric charge of the toner being 5 μC/g which was outside of the previously mentioned appropriate range, containing the organic tin catalyst (tin dioctoate), was prepared in the same manner as mentioned in Example 1. By use of this developer, copies were made by a commercially available dry-type electrophotographic copying machine. However, no clear copies were made continuously as shown in FIG. 14.

From the above results, according to the present invention, more stable images can be obtained by controlling the quantity of electric charges in the toner by use of the above described carrier particles than by use of a charge controlling agent.

What is claimed is:

1. Carrier particles for use in two-component dry-type developers for electrophotography, comprising: core particles coated with a hardened silicone resin having a three-dimensional network structure comprised of Si-O-Si bonds, said core particles being made of a material selected from the group consisting of a magnetic metal, a non-magnetic metal and a non-metallic material, with the particle size thereof being in the range of 30 μm to 1,000 μm, said carrier particles having been prepared by dissolving an organosiloxane capable of forming said silicone resin and an organic tin catalyst capable of catalyzing hardening of said silicone resin in an organic solvent to form a silicone varnish, then coating said core particles with said varnish and drying said varnish to form coatings on said core particles, then heating said coated core particles at a temperature in the range of about 100° C. to about 250° C. to harden the silicone resin, said organic tin catalyst being selected from the group consisting of:

(No. 1) $R_2Sn(OCOR')_2$ wherein R and R' each represent an alkyl group of $C_1 \sim C_{12}$.

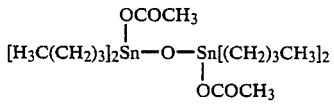
(No. 2)

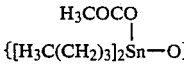
(No. 3)

$[CH_3(CH_2)_3]_2Sn(OCH_3)_2$ (No. 4)

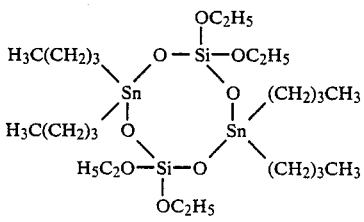
(No. 5)

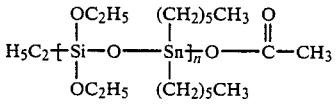
(No. 6)

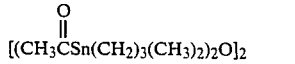
(No. 7)

2. Carrier particles as claimed in claim 1, wherein said silicone resin is a polymeric material comprising an organopolysiloxane with a three-dimensional network structure containing Si-O-Si bonds as the main chain, represented by the formula

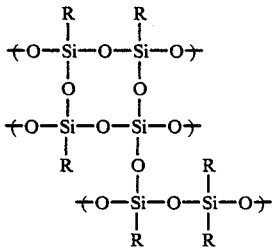

wherein some of the Rs represent a group selected from the group consisting of a lower alkyl group, a phenyl group, an alkyd-modified-, an acryl-modified-, an epoxy-modified-, an amino-modified-, a carboxy-modified-, an alcohol-modified-, a fluorine-modified-, a polyether-modified-, an urethane-modified-, a nitrile-modified-, a polyester-modified-lower alkyl group or -phenyl group, and the remainder of the Rs represent a group selected from the group consisting of hydrogen, a lower alkoxy group, a hydroxyl group and a vinyl group.

3. Carrier particles as claimed in claim 1, wherein the amount of said organic tin catalyst is in the range of from 0.1 wt. % to 3 wt. % of the non-volatile components of said silicone resin.

4. Carrier particles as claimed in claim 1, wherein said core particles are coated with said silicone resin with a thickness ranging from 0.1 μm to 20 μm.

5. Carrier particles as claimed in claim 1, in which said organic tin catalyst is dibutyl tin dilaurate.

6. Carrier particles for use in two-component dry-type developers for electrophotography, comprising: core particles having a particle size in the range of from 30 μm to 1000 μm and coated with a layer consisting essentially of a hardened silicone resin having a three-dimensional network structure consisting essentially of Si-O-Si bonds, said carrier particles having been prepared by dissolving methylpolysiloxane capable of forming said silicon resin and an organic tin catalyst capable of catalyzing hardening of said methylpolysiloxane in an organic solvent to form a silicone varnish, then coating said core particles with said varnish and drying said varnish to form coatings on said core particles, then heating said coated core particles at a temperature in the range of about 100° C. to about 250° C. to harden the silicone resin, said organic tin catalyst being selected from the group consisting of:

$R_2Sn(OCOR')_2$ wherein R and R' each represent an alkyl group of $C_1$ to $C_{12}$.

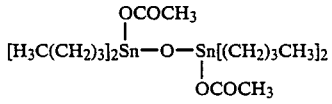

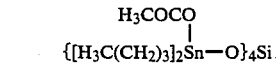

$[CH_3(CH_2)_3]_2Sn(OCH_3)_2$

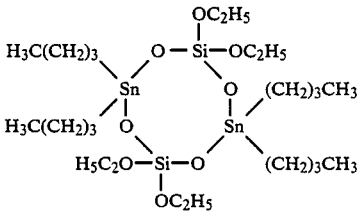

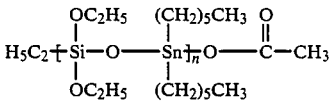

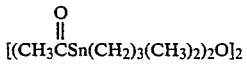

* * * * *